United States Patent [19]

Davidson et al.

[11] 4,034,701

[45] July 12, 1977

[54] PARTICLE DISPENSER

[75] Inventors: James R. Davidson, Rochester; William J. Hanson, Pittsford; Stephen K. Wilson, Webster, all of N.Y.

[73] Assignee: Xerox Corporation, Stamford, Conn.

[21] Appl. No.: 266,875

[22] Filed: June 28, 1972

[51] Int. Cl.[2] ..... G03G 15/08

[52] U.S. Cl. ..... 118/7; 118/657; 222/56; 222/DIG. 1; 118/646

[58] Field of Search ..... 117/17.5; 118/7, 636, 118/637; 355/3

[56] References Cited

U.S. PATENT DOCUMENTS

| | | | |
|---|---|---|---|
| 3,318,212 | 5/1967 | Rubin | 95/1.7 |
| 3,339,807 | 9/1967 | Eichorn | 222/171 |
| 3,348,522 | 10/1967 | Donohue | 118/7 |
| 3,606,864 | 9/1971 | Perun | 118/637 |
| 3,693,581 | 9/1972 | Quant | 118/7 |
| 3,698,926 | 10/1972 | Furuichi | 117/17.5 |
| 3,765,654 | 10/1973 | Rarey et al. | 259/4 |
| 3,854,449 | 12/1974 | Davidson | 118/637 |

*Primary Examiner*—Mervin Stein
*Attorney, Agent, or Firm*—J. J. Ralabate; H. Fleischer; M. J. Colitz, Jr.

[57] ABSTRACT

An apparatus in which a quantity of particles is stored for being dispensed gradually therefrom. The particles remain stored therein when the apparatus is stationary, and are discharged therefrom when the apparatus undergoes oscillatory movement.

3 Claims, 5 Drawing Figures

PARTICLE DISPENSER

BACKGROUND OF THE INVENTION

This invention relates generally to an electrostatographic printing machine, and more particularly concerns an improved toner dispensing apparatus for use therein.

Electrostatographic printing includes electrographic printing and electrophotographic printing. In both of these processes, an electrostatic latent image is recorded corresponding to the original document to be reproduced. This is achieved in electrophotography by charging a photosensitive element having a photoconductive insulating layer to a substantially uniform potential. The charged photoconductive surface is exposed to a light image of the original document. As a consequence of the exposure, the charge is selectively dissipated in the irradiated areas in accordance with the light intensity reaching the photoconductive surface to create an electrostatic latent image thereon. Electrographic printing differs from electrophotographic printing in that the electrostatic latent image is created without the use of photosensitve materials. That is, electrophotography requires the use of a suitable photoconductor whereas electrography does not.

Development of the electrostatic latent image, in electrophotography and electrography, is accomplished by contacting the latent image with a developer mix. Typical developer mixes generally comprise dyed or colored thermoplastic particles, known in the art as toner particles, mixed with carrier granules, such as ferromagnetic granules. The toner particles and carrier granules are triboelectrically attracted to one another such that the tone particles adhere to the outer surface of the carrier granules. As the developer mix contacts the latent image, the greater attractive forces produced thereby casue the transfer and adherence thereto of the toner particles in image configuration.

It is apparent that during the development cycle, the toner particles are depleted from the developer mix. As the toner particles in the developer mix are depleted, during the development of the latent image, additional toner particles must be furnished thereto to maintain copy density at a desirable level. Hence, in order to produce an efficient printing machine, it is necessary to conveniently and effectively replenish the toner particles used in the formation of copies. Hereinbefore, predetermined amounts of toner particles were added periodically to the developer mix. This was achieved by the operator manually adding toner particles to the mix, or by a dispenser discharging fixed amounts of particles in the mix at specific time intervals. The particle dispensers heretofore utilized frequently metered incorrect amounts of toner particles into the developer mix. Thus, if the percentage of toner particles in the developer mix were too small, the copy density would be too low and contrast disappears, whereas if the percentage of toner particles in the developer mix were too great, copies would be smudged.

Accordingly, it is a primary object of the present invention to improve dispensing of toner particles into the developer mix of an electrostatographic printing machine.

SUMMARY OF THE INVENTION

Briefly stated and in accordance with the present invention there is provided an apparatus for dispensing particles. The apparatus includes means for storing a supply of the particles and, in communication therewith, is means for discharging the particles therefrom. Moreover, means are provided for oscillating the storing means. The discharge means is arranged to prevent the dispensing of particles when the storing means is stationary, while permitting particles to be dispensed therefrom when the storing means is oscillated.

BRIEF DESCRIPTION OF THE DRAWINGS

Other objects and advantages of the present invention will become apparent upon reading the following detailed description and upon reference to the drawings, in which.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
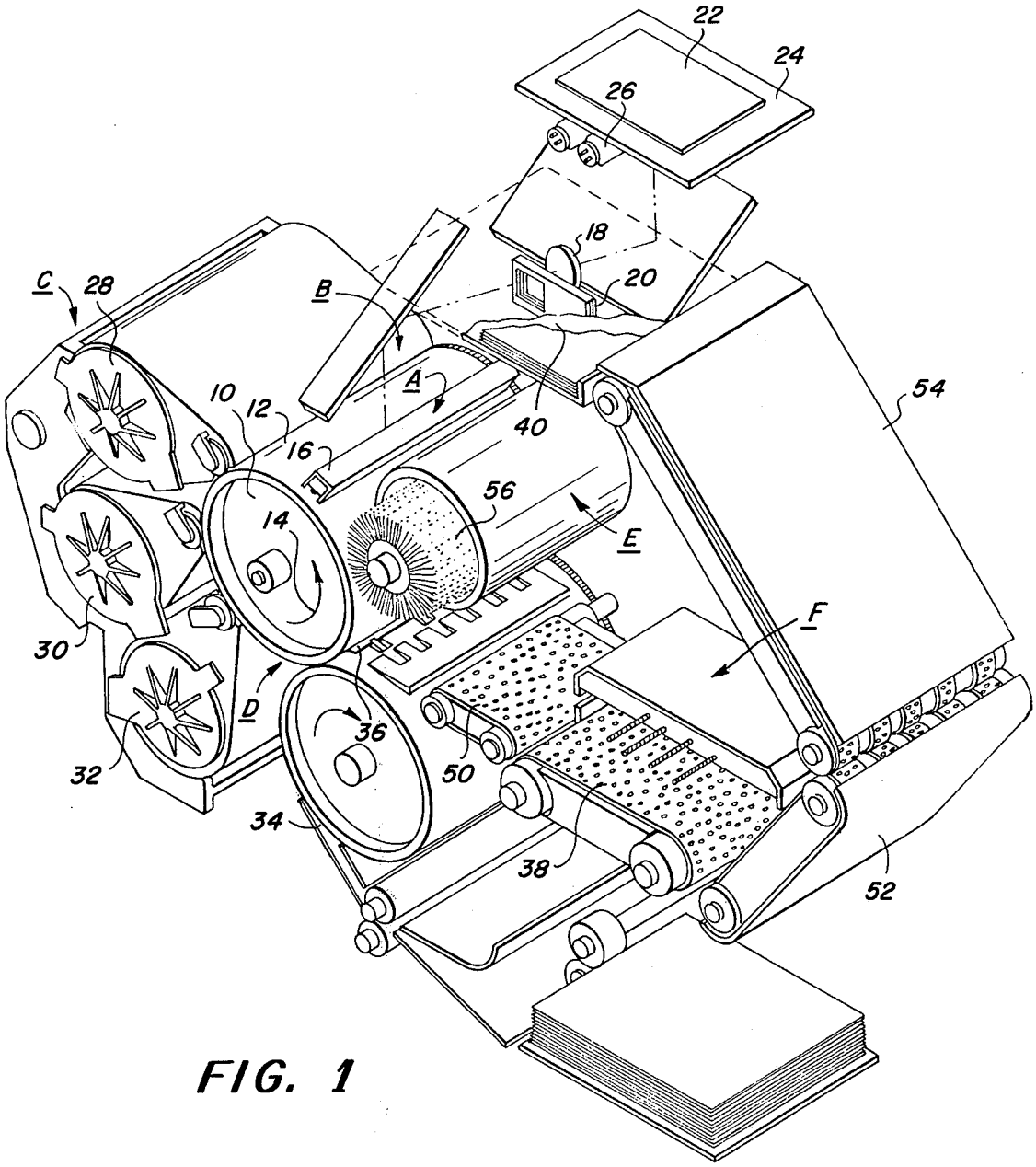
FIG. 1 is a schematic perspective view of an electrophotographic printing machine embodying the features of the present invention.

For a general understanding of an electrostatographic printing machine, in which the present invention may be utilized, reference is had to the drawings wherein like reference numerals have been used throughout to designate like elements. FIG. 1 schematically illustrates the various components of an electrophotographic printing machine producing multi-color copies from a color original. As in all electrophotographic machines of the type illustrated, a light image of a document to be reproduced is projected onto a charged photoconductive surface to form an electrostatic latent image thereon. The latent image is developed with toner particles to form a powder image on the photoconductive surface. Thereafter, the powder image is electrostatically transferred to a sheet of support material to which it may be fixed permanently by a suitable fusing device.

The printing machine depicted in FIG. 1 employs a photoconductive member, such as rotatably mounted drum 10 having a photoconductive surface 12 thereon. Photoconductive surface 12, preferably, is formed of a material having a relatively panchromatic response to white light. Drum 10 rotates in the direction of arrow 14 to move photoconductive surface 12 sequentially through a series of processing stations.

Photoconductive surface 12 first passes through charging station A which has positioned thereat a corona generating device, indicated generally at 16, extending transversely thereacross. Corona generating device 16 charges drum surface 12 to a relatively high and substantially uniform potential.

The charged drum surface is next rotated to exposure station B which includes a moving lens system, generally designated by the reference numeral 18, and a color filter mechanism, shown generally at 20. An original document 22 is stationarily supported on a transparent viewing platen 24 wherein successive incremental areas of original 22 are illuminated by means of a moving lamp assembly 26. Lens system 18 is adapted to scan successive areas of original 22 being illuminated on platen 24 and to focus the light onto photoconductive surface 12. Lamp assembly 26 and lens system 18 are moved in timed relation with photoconductive surface 12 to produce a non-distorted flowing light image of the original on photoconductive surface 12. During exposure, filter mechanism 20 interposes selective color filters onto the optical light path of lens 18. Color filters 20 operate on the light passing through lens 18 to record the electrostatic latent image on photoconductive surface 12 corresponding to a specific color of the flowing light image of the original.

After the electrostatic latent image is recorded on photoconductive surface 12, drum 10 is rotated to development station C which includes three individual development units generally indicated by reference numerals 28, 30 and 32, respectively. The development units are all of a type referred to in the art as "magnetic brush development systems". In a magnetic brush development system, a magnetizable developer mix having carrier granules and toner particles is continually brought through a directional flux field to form a brush of developer material. The developer mix is continually moving to provide fresh developer mix to the brush. Preferably, the brush in the magnetic brush system comprises a magnetic member with a mass of developer mix adhering thereto by magnetic attraction. The developer mix includes carrier granules having toner particles clinging thereto by triboelectric attraction. This chainlike arrangement of the developer mix simulates fibers of a brush. Development is achieved by bringing the brush of developer mix into contact with photoconductive surface 12. Each of the development units 28, 30 and 32, respectively, apply toner particles to the electrostatic latent image recorded on photoconductive surface 12. The toner particles of each development unit are adapted to absorb light within a preselected spectral region of the electromagnetic wave spectrum corresponding to the wave length of light transmitted through the filter. For example, a latent image formed by passing the light image through a green filter will record areas in the red and blue portion of the spectrum as areas of relatively high charge density on photoconductive surface 12, while the green light rays will pass through the filter and cause the charge density on photoconductive surface 12 to be reduced to a voltage level ineffective for development. The charged areas are then made visible by applying green absorbing (magenta) toner particles to the latent image recorded on the photoconductive surface 12. Similarly, a blue separation is developed with blue absorbing (yellow) toner particles, while a red separation is developed with red absorbing (cyan) toner particles.

After development, the now visible image is moved to transfer station D where the image is transferred to a sheet of final support material 36, such as plain paper amongst others, by means of a transfer member, i.e. a bias transfer roll, shown generally at 34. The surface of transfer roll 34 is electrically biased to a potential having a magnitude and polarity sufficient to electrostatically attract toner particles from photoconductive surface 12 to support sheet 36. Transfer roll 34 is adapted to secure releasably thereto a single sheet of final support material 36 for movement in a recirculating path, roll 34 being arranged to move in synchronism with photoconductive surface 12 enabling support material 36 to receive successive toner powder images in superimposed registration with one another. The aforementioned steps of charging the photoconductive surface, exposing the photoconductive surface to a color separated flowing light image of the original, developing the electrostatic latent image recorded on the photoconductive surface with appropriately colored toner particles, and transferring the toner powder image to a sheet of final support material, e.g. a transparency or opaque copy sheet, are repeated a plurality of cycles to form a multi-color copy of an original document to be reproduced.

After the last transfer operation, support sheet 36 is stripped from roll 34 and transported on endless belt conveyor 50 to fixing station F where a fuser, indicated generally at 38, coalesces the toner powder image to support sheet 36. Thereafter, sheet 36 is advanced by endless belt conveyors 52 and 54 to catch tray 40 for subsequent removal from the machine by an operator.

The last processing station in the direction of rotation of drum 10, as indicated by arrow 14, is cleaning station E. A rotatably mounted fibrous brush 56 is positioned in cleaning station A and is maintained in contact with photoconductive surface 12 of rotating drum 10 to remove residual toner particles remaining thereon after each transfer operation.

Figure 2:
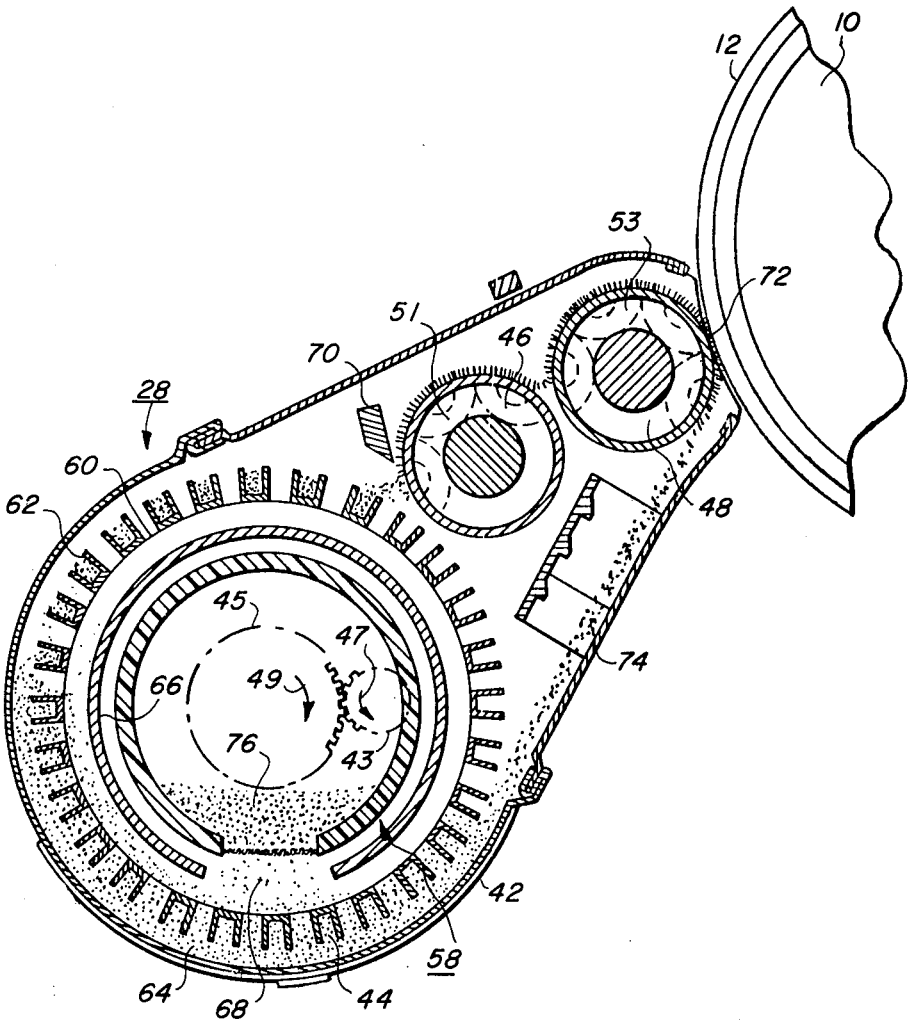
FIG. 2 is a sectional elevational view of a development unit having the present invention incorporated therein and adapted for usage in the printing machine illustrated in FIG. 1.

Referring now to FIG. 2, there is shown one development unit, i.e. developer unit 28, in detail. Development unit 28 is depicted in a sectional elevational view to indicate more clearly the various components included therein. Only development unit 28 has been described in detail as development units 30 and 32 are nearly identical thereto. The development units are distinguishable from one another by the color of toner particles contained therein and minor geometrical differences due to the angle of mounting. Development unit 28 may have yellow toner particles therein, unit 30 magenta toner particles and unit 32 cyan toner particles, although different color combinations may be utilized. For purposes of explanation, development unit 28 will hereinafter be described in detail.

Turning once again to FIG. 2, the principle components of toner depositing means or development unit 28 are developer housing 42, mixing means or paddlewheel 44, transport means or roll 46, development means or roll 48 and toner dispensing means, indicated generally at 58. Paddle wheel 44 includes a rotary driven hub member 60 with buckets or scoops 62 spaced substantially equal around the periphery thereof. As paddle wheel 44 rotates, developer mix 64 is elevated from the lower region of housing 42 to the upper region thereof. In operation, clutch gear 43 meshes with gear 45 secured to paddle wheel 44. As gear 43 rotates in the direction of arrow 47, gear 45 is rotated in the direction of arrow 49, thereby also rotating paddle wheel 44 in the direction of arrow 49. When developer mix 64 reaches the upper region of housing 42, it is lifted from the paddle wheel bucket 62 to transport roll 46. Alternate buckets of paddle wheel 44 have apertures therein so that the developer mix carried in these areas falls back to lower regions of developer housing 42. As the developer mix falls to the lower region of developer housing 42, it cascades over cylindrical member or shroud 66 which is of a tubular configuration with an aperture 68 in the lower region thereof. Developer mix 64 is recirculated in this manner so that the carrier granules are continuously agitated to mix with fresh toner particles. This generates a strong triboelectric charge between the carrier granules and toner particles. As developer mix 64, in the paddlewheel buckets approaches transport roll 46, the magnetic fields produced by the fixed magnets 51 attract developer mix 64 thereto. Transport roll 46 moves developer mix 64 in an upwardly direction by the frictional force exerted between the roll surface and developer mix. A surplus of developer mix 64 is furnished, and metering blade 70 is provided to control the amount of developer mix 64 carried over the top of transport roll 46. Surplus developer mix 64 is sheared from transport roll 46 and falls in a downwardly direction towards paddle wheel 44. As the surplus developer mix increases, it falls through the apertures of paddle wheel 44 in a downwardly direction into the lower region of developer housing 42.

The developer mix which passes metering blade 70 is carried over transport roll 46 and attracted to developer roll 46 by the magnetic field produced by fixed magnets 53 therein. Developer roll 46 moves developer mix 64 into development zone 72 located between photoconductive surface 12 and developer roll 48. The electrostatic latent image recorded on the photoconductive surface is developed by contact with moving developer mix 64, i.e. the charged areas of photoconductive surface 12 electrostatically attract the toner particles from the carrier granules of developer mix 64. At the exit of development zone 72, the strong magnetic fields in the direction generally tangential to developer roll 48 continue to secure thereto residual developer mix and denuded carrier granules, i.e. carrier granules lacking toner particles. Upon passing from the development zone, the residual developer mix and denuded carrier granules enter a region relatively free from magnetic forces and fall from developer roll 48 in a downwardly direction into the lower region of developer housing 42. As the residual developer mix and denuded carrier granules descend, they pass through mixing baffle 74 which directs the flow from the ends towards the center of developer housing 42 to provide mixing in this direction.

Cylindrical shroud 66 serves to control the fall of the surplus developer mix and denuded carrier granules such that they mix with the toner particles rather than simply falling into the lower region of developer housing 42. Furthermore, shroud 66 isolates, from the developer mix, an interior cylindrical enclosure which is used to house toner dispensing means 58. Toner dispensing means 58 contains a fresh supply of toner particles 76 which passes through aperture 68 in shroud 66 into the stream of developer mix 64. Adding toner particles at this location insures that it cannot be carried into development zone 72 without some degree of mixing with the denuded carrier granules. Additional toner particles are added to the developer mix in order to replace that used in forming powder images, and thereby maintains the concentration thereof substantially constant, providing uniform color image developability.

Figure 3:
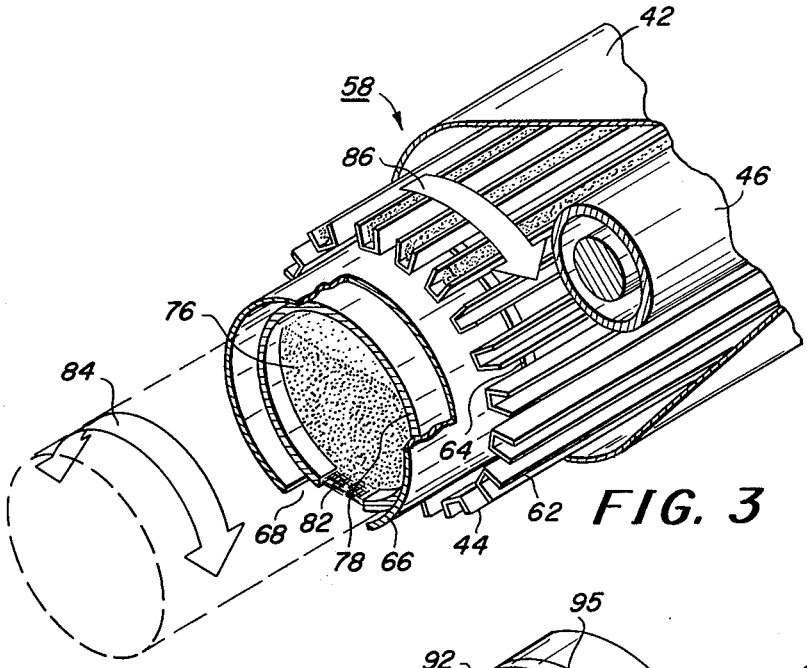
FIG. 3 is a fragmentary perspective view of the toner dispensing apparatus of the present invention.
Figure 4:
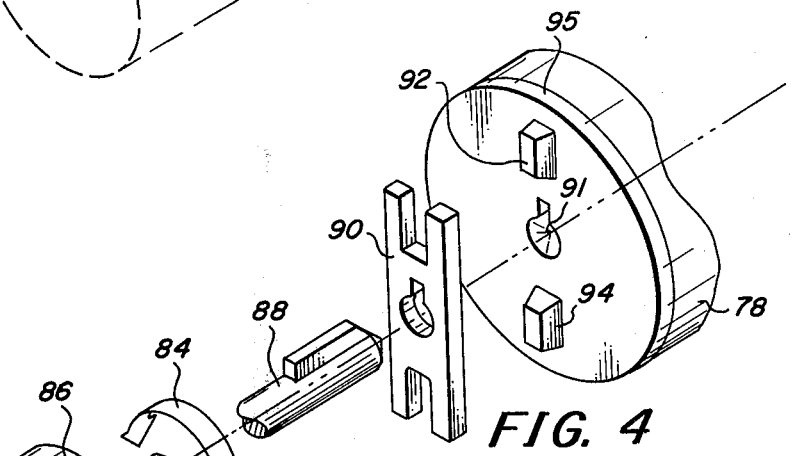
FIG. 4 is a fragmentary perspective view of a drive arrangement for the toner cartridge of the toner dispensing apparatus depicted in FIG. 3.
Figure 5:
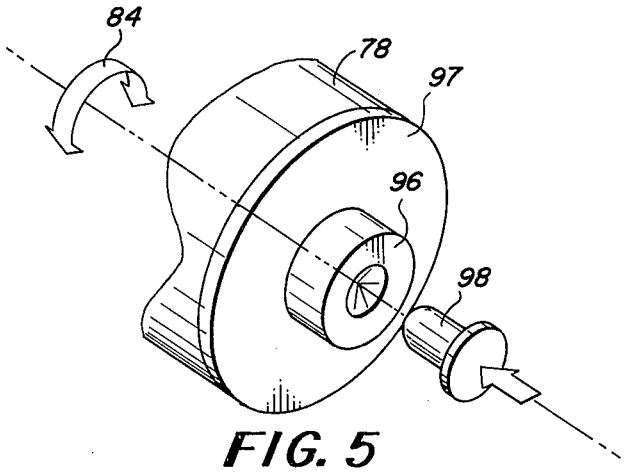
FIG. 5 is a fragmentary perspective view of the mounting arrangement for the toner cartridge of the toner dispensing apparatus shown in FIG. 3.

Turning to FIGS. 3 through 5, inclusive, the detailed structural configuration of toner dispensing means 58 is shown therein. As shown in FIG. 3, tubular member or toner cartridge 78 houses a supply of toner particles 76 corresponding in color to the respective developer unit, i.e. toner particles in development unit 28 would be yellow, those in 30, magenta, those in 32, cyan. Toner cartridge 78 includes a slot therein with a screen 82 thereover. When tubular member 78 is stationary, toner particles 76 form a bridge over the holes in screen 82 and are not dispensed therethrough. However, when toner cartridge 78 is oscillated in the direction of arrow 84, this bridging effect, caused by toner particles 76, is broken causing toner particles 76 to pass through screen 82 and into the lower region of developer housing 42. In the preferred construction, toner cartridge 78 may be molded from a plastic material with a perforated region comprising a plurality of substantially parallel equally spaced slots replacing screen 82. Shroud 66 is disposed concentrically about toner cartridge 78 and spaced therefrom. Aperture of longitudinally extending slot 68 in shroud 66 is positioned in alignment with the perforated region or screen 82 of cartridge 78 to guide toner particles 76 being dispensed therefrom in a downwardly direction. Hub 64 of paddle wheel is disposed concentrically about shroud 66 in a spaced relation therewith so as to rotate in the direction of arrow 86. Toner cartridge 78 is journaled for oscillatory movement substantially about its longitudinal axis as indicated by arrow 84. The mounting arrangement permitting the oscillatory movement of the toner cartridge 78 is indicated more clearly in FIGS. 4 and 5.

Turning now to FIGS. 4 and 5 there is shown, in detail, the mounting system for cartridge 78. Shaft 88 of oscillating means or motor 86 is keyed to dog 90 which, in turn, is keyed to cartridge 78 at protuberances 92 and 94, respectively, on end cap 95. Motor 86 is energized to oscillate toner cartridge 78 substantially about its longitudinal axis, as indicated by arrow 84, to thereby dispense toner particles therefrom in a downwardly direction. Thus, as depicted in FIG. 4, toner cartridge 78 is supported for oscillatory movement by motor shaft 88, keyed to dog 90 which drives cartridge 78 by engaging proturberances 92 and 94 on end cap 95. It is apparent that shaft 88 also passes through key-way 91 in end cap 95 to be in positive engagement therewith. Key-way 91 insures that toner cartridge 78 is aligned properly when inserted in development unit 28. FIG. 5 illustrates the support arrangment for the side of cartridge 78 opposed from motor 86. As indicated therein, bushing 96 is mounted on end cap 97 of cartridge 78. Journal 98 mates with bushing 96 so as to permit oscillation of cartridge 78 substantially about the longitudinal axis thereof.

Energizing means or a suitable electrical control circuit (not shown) activates motor 86 to oscillate cartridge 78 and dispense toner particles therefrom into the lower portion of housing 42. As toner particles are dispensed from cartridge 78, the concentration thereof within the developer mix is increased. The toner particle concentration within the developer mix is detected by suitable sensing means which, in turn, develops an error signal indicative of the deviation of toner particle concentration in the developer mix from the desired reference concentration. This error signal actuates the electrical control circuit so as to excite motor 86 causing toner particles to be dispensed from cartridge 78 into the developer mix. By way of example, a rotating reflective disc may be disposed directly in the developer mix and electrically biased to attract toner particles therefrom. The quantity of toner particles attracted to the surface of the disc is indicative of the toner particle concentration. A light beam is directed to reflect from the surface onto a photoelectric unit. The intensity of light striking the photoelectric unit is dependent upon the quantity of toner particles adhering to the disc. The photoelectric unit is calibrated to actuate a dispensing apparatus which discharges toner particles into the developer mix when the signal from the photoelectric unit deviates from a desired reference level. This concept is disclosed in U.S. Pat. No. 3,399,652 issued to Gawron in 1968, and is further amplified and described by many related patents in the art.

In recapitulation, it is apparent that the toner dispensing apparatus of the present invention meters precise quantities of toner particles into the developer mix. This maintains the concentration of toner particles therein substantially constant to improve multi-color copies produced on an electrophotographic printing machine.

It is, therefore, evident that there has been provided in accordance with this invention, an apparatus for dispensing toner particles that fully satisfies the objects, aims and advantages set forth above. While this invention has been described in conjunction with specific embodiments thereof, it is evident that many alternatives, modifications, and variations will be apparent to those skilled in the art. Accordingly, it is intended to embrace all alternatives, modifications and variations that fall within the spirit and broad scope of the appended claims.

What is claimed is:

1. An electrostatographic printing machine of the type having an electrostatic latent image of an original document to be reproduced recorded on an insulating medium, wherein the improvement includes:

a housing member defining a chamber for storing a developer mix comprising carrier granules and toner particles;

a generally tubular member journaled for oscillatory movement substantially about the longitudinal axis thereof in said housing member and defining a chamber for storing a supply of toner particles therein, said tubular member having a perforated portion arranged to prevent the passage of toner particles therethrough when said tubular member is stationary while allowing the passage of toner particles therethrough when said tubular member is oscillated;

means for oscillating said tubular member to dispense toner particles therefrom into the chamber of said housing member;

a stationary, generally cylindrical member disposed concentrically about said tubular member and spaced therefrom, said cylindrical member having an aperture therein substantially aligned with the perforated portion of said tubular member;

a rotary driven hub member spaced from and disposed concentrically about said cylindrical member with a plurality of spaced apertures therein adapted to enable the toner particles being dispensed from said tubular member to pass therethrough; and a plurality of substantially equally spaced scoops mounted on said hub member at least one aperture interposed between each of said scoops, said scoops being arranged to move the developer mix from a first region to a second region for discharge thereat.

2. A machine as recited in claim 1, further including rotary driven transport means mounted within the chamber of said housing member closely proximate to said scoops for receiving the developer mix discharged therefrom; and rotary driven developer means mounted within the chamber of said housing member closely proximate to said transport means for receiving the developer mix therefrom, and arranged to deposit the toner particles on the insulating medium when in operative communication therewith.

3. A machine as recited in claim 2, further including:

means for sensing the concentration of toner particles in the developer mix stored in the chamber of said housing member;

means for generating an error signal indicative of the deviation of toner particle concentration in the developer mix from the desired reference concentraton thereof; and means, responsive to the error signal, for energizing said oscillating means to oscillate said tubular member for dispensing toner particles therefrom into the chamber of said housing member to increase the concentration of toner particles in the developer mix.

* * * * *